US009962604B1

(12) United States Patent
Farley

(10) Patent No.: US 9,962,604 B1
(45) Date of Patent: May 8, 2018

(54) GAME TABLE

(71) Applicant: Indian Industries, Inc., Evansville, IN (US)

(72) Inventor: Patrick Farley, Bay Shore, NY (US)

(73) Assignee: Indian Industries, Inc., Evansville, IN (US)

( * ) Notice: Subject to any disclaimer, the term of this patent is extended or adjusted under 35 U.S.C. 154(b) by 0 days. days.

(21) Appl. No.: 15/381,331

(22) Filed: Dec. 16, 2016

(51) Int. Cl.
*A63F 7/06* (2006.01)
*A63F 7/00* (2006.01)
*A63F 9/00* (2006.01)

(52) U.S. Cl.
CPC ..... *A63F 7/06* (2013.01); *A63F 7/0017* (2013.01); *A63F 7/0616* (2013.01); *A63F 7/0632* (2013.01); *A63F 9/0079* (2013.01); *A63F 2009/0087* (2013.01); *A63F 2250/05* (2013.01)

(58) Field of Classification Search
CPC ..... A63F 7/06; A63F 7/07; A63B 69/00
See application file for complete search history.

(56) References Cited

U.S. PATENT DOCUMENTS 1,934,381 A 11/1933 Slosson
2,832,596 A 4/1958 Brown
3,724,851 A 4/1973 Cecchetti
3,954,267 A * 5/1976 Freeman ..... A63F 7/3603 273/126 A
D247,127 S 1/1978 Kavka
4,076,242 A * 2/1978 Joseph ..... A63F 7/0684 273/108.51
5,011,147 A * 4/1991 Thomas ..... A63B 67/14 273/126 A
5,605,328 A 2/1997 Rudell et al.
5,630,760 A * 5/1997 Brown ..... A63F 7/36 273/108.52
6,092,805 A 7/2000 Lee
6,155,564 A * 12/2000 Tsai ..... A63F 7/3603 273/108.1
6,349,939 B1 2/2002 Tsai
6,402,140 B1 6/2002 Wood
6,764,409 B1 7/2004 Voden
6,773,010 B2 8/2004 Zucchi et al.
6,854,728 B2 2/2005 Oister et al.
6,991,231 B1 1/2006 Tien
7,219,892 B2 5/2007 Corrado
7,389,986 B2 6/2008 Tsai
7,458,579 B2 12/2008 Tsai et al.
7,690,653 B2 4/2010 Simon
7,992,872 B2 8/2011 Simon
8,276,914 B2 10/2012 Tsai
8,302,965 B2 11/2012 Grant
(Continued)

*Primary Examiner* — Michael Dennis
(74) *Attorney, Agent, or Firm* — Woodard, Emhardt, Moriarty, McNett & Henry, LLP; Charles Meyer

(57) ABSTRACT

A game table is illustrates as a combination of the game of table soccer (also called foosball) and air hockey. The game table can be easily converted between a soccer game configuration and an air hockey configuration. In one aspect, the sidewalls of the game table incorporate at least one bushing structure allowing each rod to be selectively disengaged. In certain aspects the game table can be used to play a game using soccer player rods and figures and using a playing piece which floats on an air cushion. In certain embodiments, an asymmetric game playing piece may be used.

16 Claims, 5 Drawing Sheets

(56) References Cited

U.S. PATENT DOCUMENTS

| | | | |
|---|---|---|---|
| 8,403,326 | B1 | 3/2013 | Flanagan et al. |
| 8,790,170 | B2 | 7/2014 | Arnone et al. |
| 8,944,899 | B2 | 2/2015 | Arnone et al. |
| 9,180,339 | B2 | 11/2015 | Raniere |
| 9,216,318 | B2 | 12/2015 | Raniere |
| 9,498,677 | B2 | 11/2016 | Raniere |
| 2004/0046317 | A1 | 3/2004 | Oister et al. |
| 2005/0029734 | A1 | 2/2005 | Corrado |
| 2005/0035541 | A1 | 2/2005 | Oister et al. |
| 2006/0043667 | A1 | 3/2006 | Schlaefer |
| 2006/0091600 | A1 | 5/2006 | Schlaefer |
| 2007/0164509 | A1 | 7/2007 | Hylak et al. |
| 2008/0150230 | A1 | 6/2008 | Bowe |
| 2010/0084812 | A1 | 4/2010 | Guerzini et al. |
| 2010/0308534 | A1 | 12/2010 | Lu |
| 2015/0141128 | A1 | 5/2015 | Arnone et al. |
| 2016/0325163 | A1 | 11/2016 | Tsai |

* cited by examiner

GAME TABLE

FIELD OF THE INVENTION

The present system relates to game tables and, in particular, a combination table soccer and hockey game table.

BACKGROUND OF THE INVENTION

Watching and participating in sporting events and games is a popular pastime for many people. However, due to time, space and the number of people needed for most such games, it is not always practical to arrange a full-scale game at any particular time. Moreover, due to the skill and physical conditioning required, plus the potential injuries from many such games, individuals are not always prepared to participate in a full-scale game. As a spin-off from full-scale games, recreational game tables such as for table soccer (sometimes called foosball), air hockey or field hockey have become popular. Game tables allow the participants to simulate a full-sized game with fewer people, less space and in a protected environment. Such game tables can, for example, be set up in basements, garages, game rooms, backyards, gyms, party facilities, patios, or otherwise and are often played with two or four people.

There have been various approaches to designing and constructing game tables for table soccer and table hockey. Typical table soccer game tables are designed so that the table users spin or rotate rods to cause the simulated soccer players to move with the rod. Additionally, the table users can push or pull the rods to cause the player pieces to move back and forth across a width of the table. A small spherical ball imitating a soccer ball is used.

In other approaches, air hockey game tables incorporate a perforated game surface and air is pumped through an array of holes defined in the game surface. A disc-shaped hockey puck piece floats or glides over the game surface on an air cushion created by the air jets through the game surface. Hand-held mallets or strikers are used to strike the hockey puck.

Traditionally, soccer game tables and hockey game tables each require a relatively large area of space for the game assembly and surrounding playing space. Moreover, the structure for soccer game tables and air hockey tables is usually mutually exclusive, requiring a table to be dedicated to one or the other. In certain arrangements combination game tables have been created for both hockey and soccer, but have required different playing surfaces, such as a rotating game table with two game surfaces or multi-game tables with stackable modules. These combination game tables have required excess complexity and cost and have suffered from limitations in size and usability.

An improved game table is desired.

SUMMARY OF THE INVENTION

In the illustrated example, the game table is a combination of the games of table soccer (also called foosball) and hockey, typically air hockey. In one configuration, the game table can be used with a ball and rotating rods with mounted soccer player figures, to play a traditional game of table soccer. The table may incorporate an air pump and a perforated playing surface. In a second configuration, a traditional game of air hockey can be played with a disc-shaped puck which floats on an air cushion over the playing surface.

In a different configuration, the combination game table can be used to play a game which combines aspects of table soccer and air hockey. The game uses the soccer player rods and figures, and the playing piece is based on a hockey puck which floats on an air cushion. The rods and soccer players can be used to strike and propel the floating playing piece.

In one aspect, the sidewalls of the game table incorporate at least one bushing structure for each rod which can be selectively disengaged. The bushing structure can be separated to allow one rod end to be lifted upward from the table, allowing the soccer player rods to be easily removed from the table. The bushing structure incorporates two pieces which can be connected, for example using a tab-in-slot arrangement with a snap-fit. One piece encircles the rod and the other piece is mounted to the table sidewall. The bushing can be unlocked easily by hand, for example by pinching a pair of finger tabs. For game play, removal/installation of the soccer player rods allows the game table to be easily converted between a soccer game configuration and an air hockey configuration.

In a further aspect, a novel game playing piece is used to play a game combining aspects of table soccer and air hockey. For example, the game playing piece may incorporate a disc-shaped lower portion capable of riding on the air cushion generated by the table. The upper portion of the game playing piece incorporates an upward projection, such as a hemispherical dome. The dome portion may be hollow. The upward projection provides sufficient height to ensure the soccer players can strike the game playing piece. The materials of the game playing piece must be sufficiently light to float on the air cushion, yet sufficiently durable to withstand repeated impacts from soccer player figures during play.

Additional objects and advantages of the described embodiments are apparent from the discussions and drawings herein.

DESCRIPTION OF THE DISCLOSED EMBODIMENTS

Figure 1:
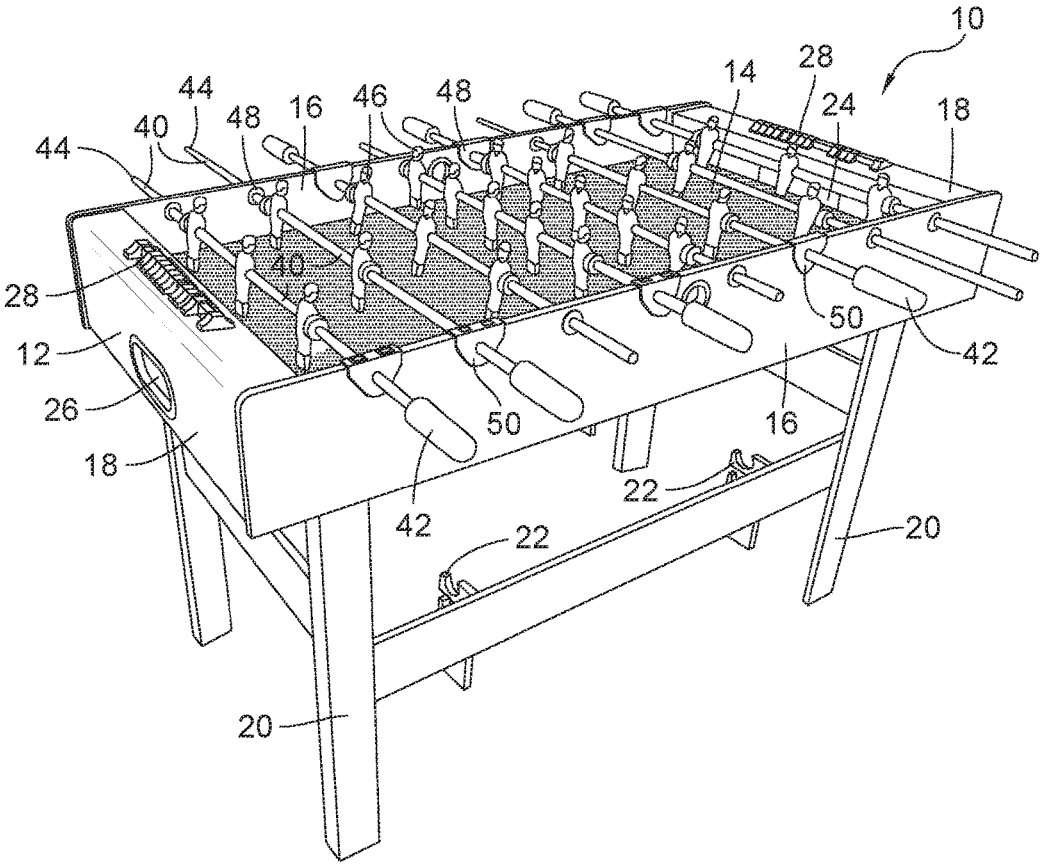
FIG. 1 is a perspective view of a representative game table according to an embodiment of the disclosure.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein are contemplated as would normally occur to one skilled in the art to which the disclosure relates.

In certain preferred embodiments of the present disclosure, a game table is provided with improved playing characteristics. In the illustrated example, the game table is a combination for playing the games of table soccer (also called foosball) and hockey, typically air hockey. In one configuration, the game table can be used with a ball and with translating and rotating rods with mounted soccer player figures, to play a game of table soccer. Further, the table incorporates an air pump and a perforated playing surface. In a second configuration, a game of air hockey can be played with a disc-shaped puck which floats on an air cushion over the playing surface. Alternately, a table hockey game can be played without an air pump, with a puck sliding over the playing surface.

In a different configuration, the combination game table can be used to play a game which combines aspects of table soccer and air hockey. The game uses the soccer player rods and figures and the playing piece floats on an air cushion. The rods and soccer players can be used to strike and propel the hockey puck.

In one aspect, the sidewalls of the game table incorporate at least one bushing structure for each rod which can be selectively disengaged. The bushing structure can be separated to allow one rod end to be lifted upward from the table, allowing the soccer player rods to be easily removed from the table. The bushing structure incorporates two pieces which can be coupled and de-coupled, for example using a tab-in-slot arrangement with a snap-fit. One piece encircles the rod and the other piece is mounted to the table sidewall. The bushing can be unlocked easily by hand, for example by pinching a pair of finger tabs. For game play, removal/installation of the soccer player rods allows the game table to be easily converted between a soccer game configuration and an air hockey configuration.

In a further aspect, a novel game playing piece is used to play the combined game. For example, the game playing piece may incorporate a disc-shaped lower portion capable of riding on the air cushion generated by the table. The upper portion of the game playing piece incorporates an upward projection, such as a hemispherical dome. The dome portion may be hollow. The upward projection provides sufficient height to ensure the soccer players can strike the game playing piece. The materials of the game playing piece must be sufficiently light to float on the air cushion, yet sufficiently durable to withstand repeated impacts from soccer player figures during play.

Figure 2:
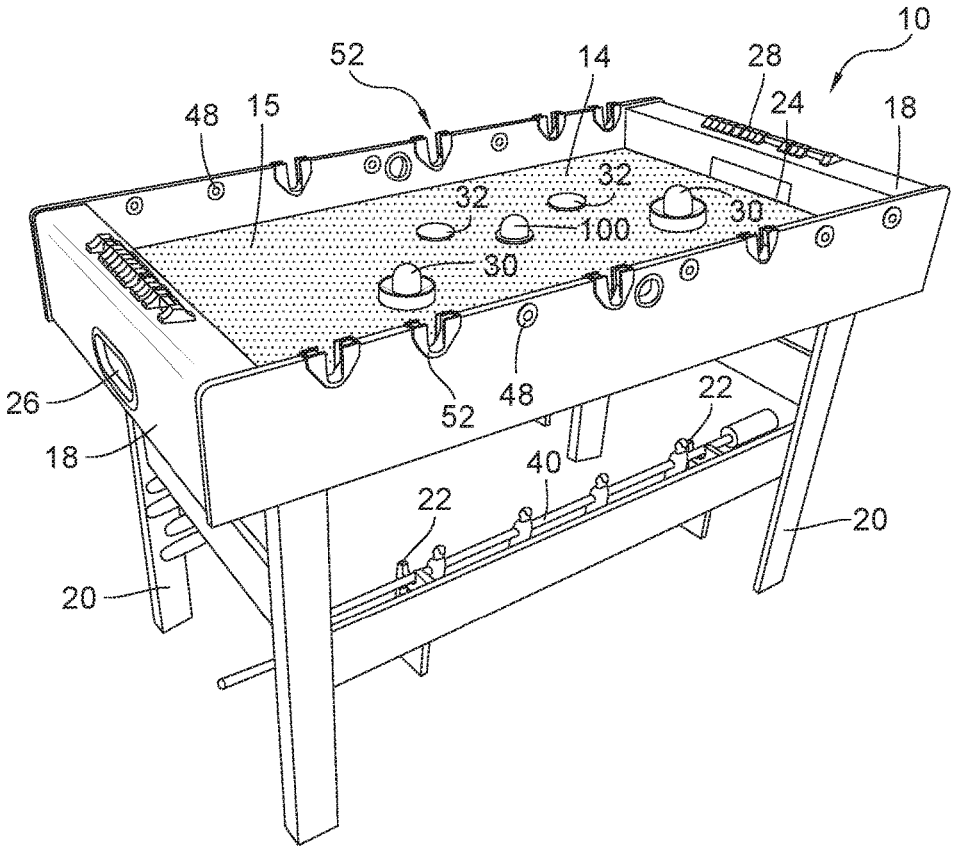
FIG. 2 is a perspective view of the embodiment of FIG. 1 with the soccer player rods removed.

One embodiment of a game table 10 is illustrated in FIGS. 1 and 2. Game table 10 incorporates a game playing cabinet or bed 12. The superstructure of game table is generally a standard style of game table including support structure such as legs 20 supporting the table bed 12. Although illustrated as generally rectangular, table bed 12 can be various shapes as would generally occur to one skilled in the art, including circular, square, or polygonal as examples. Legs 20 are standard support structures for a table, and may, for example, be four corner legs or one or more central pedestals supporting the table bed 12.

Game playing surface 14 is configured to be integral with or mounted to table bed 12 and includes a matching shape. In the illustrated embodiment, game playing surface 14 is a generally rectangular shape. However, the game playing surface can have various shapes, including circular, square, or polygonal as examples. Table bed 12 includes a frame defined by a pair of opposing parallel sidewalls 16 and an opposing pair of parallel end walls 18 which surround the game playing surface 14. The frame surrounds and extends above game playing surface 14 to a height sufficient to block escape of a playing piece from the table. The frame components can be made of standard materials such as metal, wood, laminate, particleboard, MDF or plastic, and can optionally include rubber or felt bumpers as desired.

The frame defines a pair of goal openings or goals 24 in the opposing end walls 18. Playing pieces propelled into goal openings 24 are delivered to storage chambers 26. The playing pieces can be retrieved from storage chambers 26 via exterior openings in end walls 18. Optionally, scoring mechanisms 28, such as a pair of rods on end walls 18 with sliding score indicators, can be incorporated with the frame. Alternately, other manual or electronic score keeping mechanisms can be included with game table 10.

Game playing surface 14 extends across the length and width of the area defined within the frame to form a playing area. The game playing surface is mounted to the frame or extends underneath the lower edges of the frame to eliminate gaps. The game playing surface 14 rests in place or can be attached using standard methods such as adhesive, friction, screws, bolts or other permanent or removable connectors. The game playing surface is appropriately sized and configured for the desired game. Preferred materials for the game surface are a durable plastic (such as a thick polyethylene, Plexiglass®, or Formica®), wood or glass.

In an air hockey embodiment, game playing surface 14 includes a pattern of perforations 15. Perforations 15 are fed with forced air from an internal air pump (not shown) which drives air via a series of internal channels in the table bed. The air is expelled or vented through perforations 15 forming a series of air jets which form an air cushion for an air hockey puck. Illustrated in FIG. 2 are example air hockey strikers 30 and hockey pucks 32. An example game playing piece 100 is also shown. Hockey pucks 32 are illustrated as conventional disc shaped air hockey pucks. Hockey pucks 32 are substantially planar, optionally with a slightly protruding peripheral lip on the upper and lower sides. For example, 2.5 inches is a common size for home games while 3.5 inches is used in tournament play. The puck may have a height between approximately ¼" and 3⁄16" between the top and bottom faces. In a 2.5 inch puck, the lip portion 20 may have an inner diameter of approximately 2.15 inches. A 3.5 inch puck has a lip portion proportionate to the diameter.

Game table 10 includes a series of soccer player rods 40, typically in parallel. Typically each rod is a one-piece cylindrical rod. Each rod includes an end with a handle 42 and an opposing end 44. In certain preferred embodiments, handles 42 include a piece of cushioning or gripping material, for example rubber or foam, around an end portion of rod 40. In certain embodiments, handle 42 is composed of a wood, plastic or synthetic material. The rods preferably have a circular cross-section and define a longitudinal axis. The rods 40 are arranged with the axis extending through opposing openings defined in sidewalls 16. The openings are below the top edge of the sidewalls. When rods 40 are installed through sidewalls 16, the handle 42 and opposing end 44 are external to the game playing area. During game play, each rod 40 can be rotated around its axis or translated along its axis.

Each soccer player rod 40 includes one or more simulated soccer figures 46 mounted on the rod. In the illustrated embodiment, the rod 40 nearest a goal 42 on the game table carries three players 46, the second rod from the goal carries two players 46 and the third and fourth rods for the same team carry five and three players 46 respectively. The player arrangements are normally mirror images for the two teams.

However, it should be appreciated that a different number of players 46 can be carried on the rods. The rods preferably carry each player near the top of the player's body and foot portion extends downward. Typically, the handles are on alternating sides of the table to allow access for two or four users. In certain embodiments, all or some of the rods can be arranged in pairs and there can be two adjacent handles on the same side of the table, in certain positions, such as near the goal 24 that the user on a particular side of the table is defending.

In selected embodiments of game table 10, rods 40 are selectively removable without tools to convert game table 10 from a soccer playing configuration to a hockey playing configuration. In the illustrated embodiment, each rod 40 is received in a pair of bushings to mount the rod through corresponding openings defined in sidewalls 16. In the illustrated embodiment, one permanent bushing 48 and one detachable bushing assembly 50 is used for each rod. Alternately, a pair of detachable bushing assemblies 50 can be used for each rod 40. As illustrated, the distal end 44 of each rod extends through a permanent bushing 48 while the detachable bushing assembly 50 is adjacent handle 42. Permanent bushing 48 is mounted in sidewall 16 and generally cannot be removed from the sidewall easily and/or without tools. Rod 40 is not permanently engaged to bushing 48 and can easily translate through bushing 48, for introducing or removing rod 40 from bushing 48. When the rods are removed, they can be stored or set out of the way, for example on optional storage racks 22 arranged under the game bed.

Figure 3:
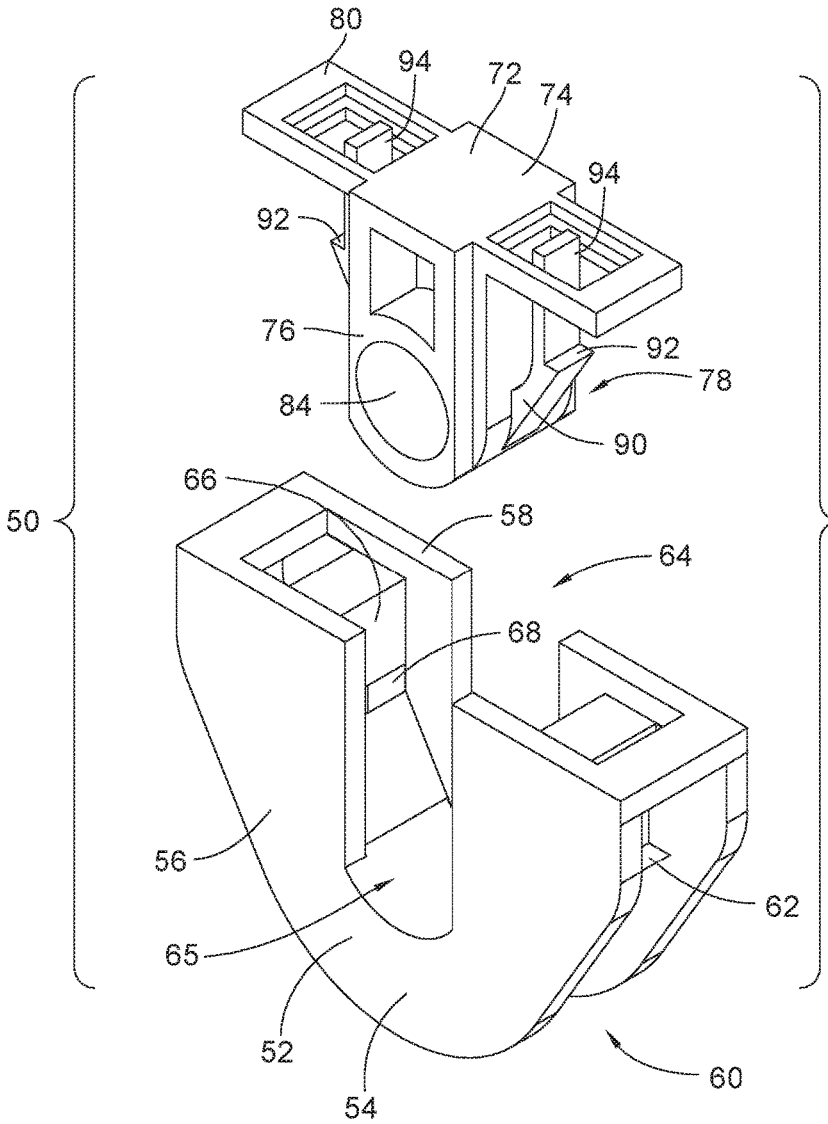
FIG. 3 is a perspective view of a representative detachable bushing assembly usable in the embodiment of FIG. 1.
Figure 4:
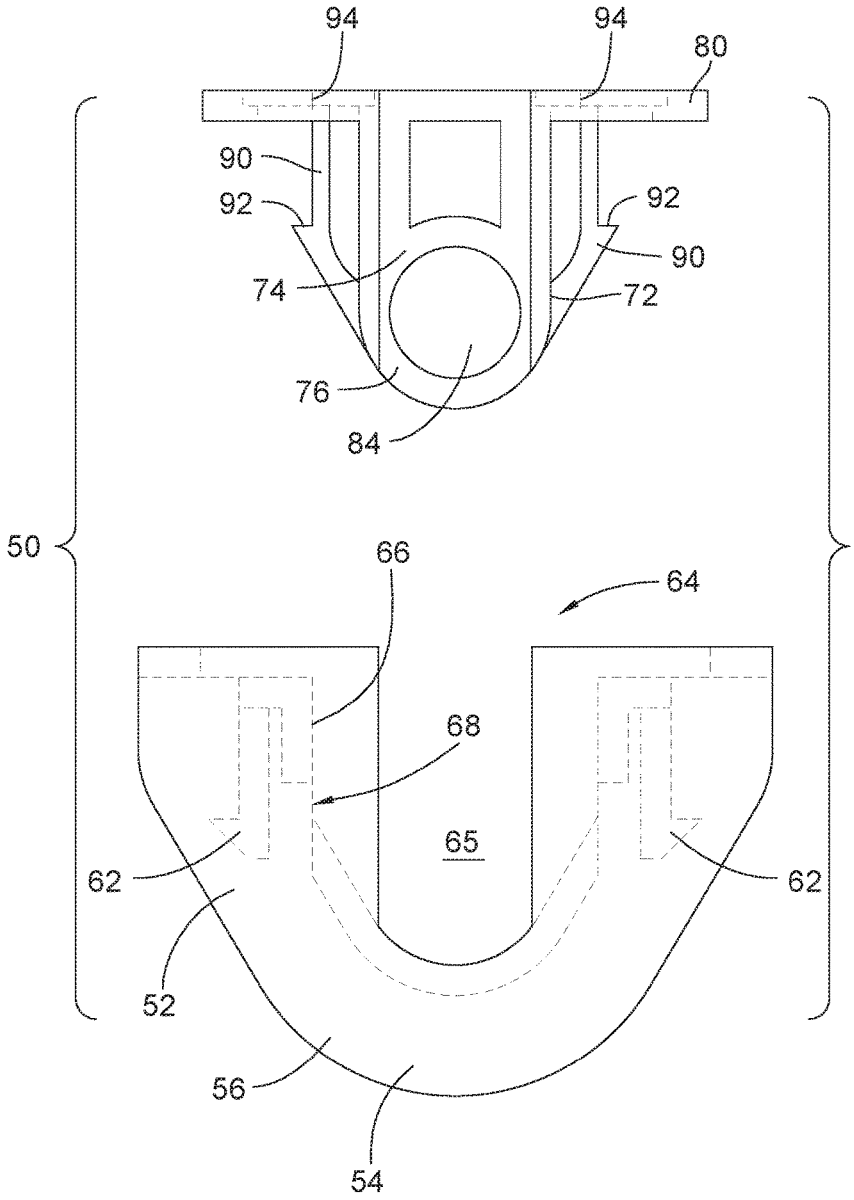
FIG. 4 is a front view of the detachable bushing assembly of FIG. 3.
Figure 5:
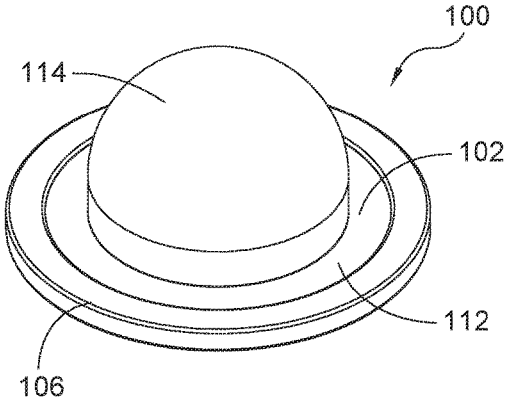
FIG. 5 is a perspective view of a game playing piece usable in the embodiment of FIG. 1.
Figure 6:
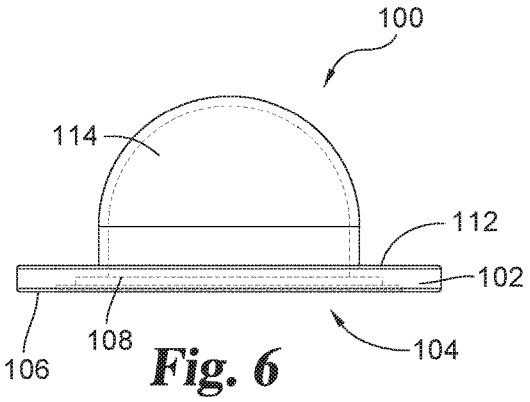
FIG. 6 is a side view of the game playing piece of FIG. 5.
Figure 7:
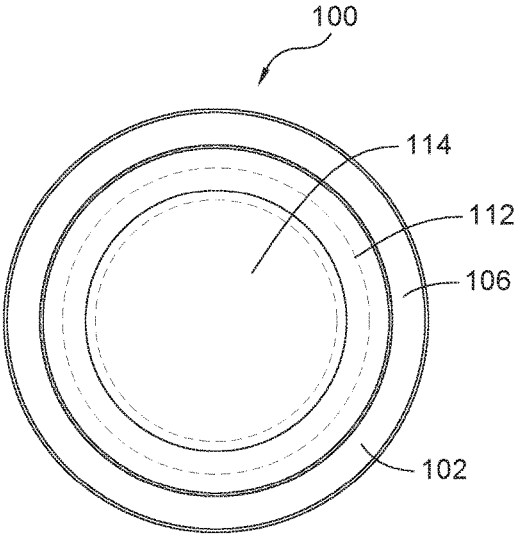
FIG. 7 is a top view of the game playing piece of FIG. 5.
Figure 8:
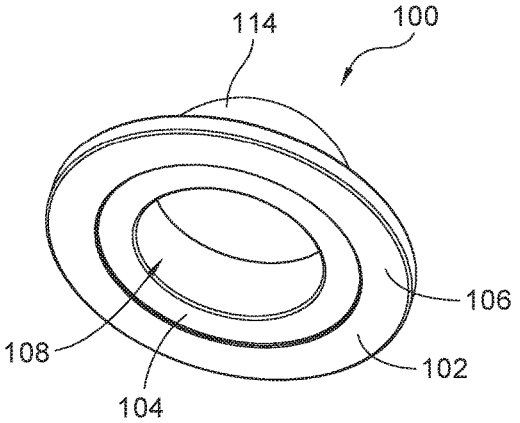
FIG. 8 is a lower perspective view of the game playing piece of FIG. 5.

Detailed views of a representative detachable bushing assembly 50 are illustrated in FIGS. 3 and 4. Detachable bushing assembly 50 includes a bracket portion 52 which can be installed in a slot defined in a sidewall 16. Detachable bushing assembly 50 also includes a bushing portion 72 mounted on rod 40. Bushing portion 72 can be selectively coupled and uncoupled from bracket portion 52.

Bracket portion 52 includes a base 54 defining a front wall 56 and a rear wall 58. FIG. 4 includes a semi-transparent view of bracket portion 52 for ease of illustration. From a top view, bracket portion has a substantially rectangular cross-section with a length parallel to sidewall 16. Front wall 56 and rear wall 58 are spaced apart to define a sidewall slot 60. Preferably, the spacing between the walls defines a width for sidewall slot 60 that approximately matches and may frictionally engage the thickness of a sidewall 16. Optionally, a friction fitting 62 may be arranged in sidewall slot 60 between the front and back walls. Friction fitting 62 may be a slightly resilient tab with a hooked end which is pressed inward to bracket portion 52 by sidewall 16 as bracket portion is introduced into a tapered slot in sidewall 16. As illustrated the hook points outward between the front and rear walls. The tapered slot in sidewall 16 may be angled or curved. The hooked end of friction fitting 62 resiliently bears against sidewall 16 and may partially penetrate into the sidewall material. The engagement or gripping force between sidewall 16 and friction fitting 62 assists in holding bracket portion 52 in place on game table 10.

Base 54 of bracket portion 52 further defines a bushing slot 64. Bushing slot 64 extends downward from the top of base 54 between front wall 56 and rear wall 58. Bushing slot 64 further defines a transverse rod channel 65. Rod channel 65 extends through bracket portion 52 through openings in the front and rear walls. The axis of rod channel 65 is perpendicular to front wall 56 and rear wall 58. Bushing slot 64 includes interior sidewalls 66 which may each define an engagement gap 68. Optionally, a lower portion of sidewalls 66 may be angled or curved inward toward the rod channel.

Detachable bushing assembly 50 also includes bushing portion 72. Bushing portion 72 includes a base 74 defining a front wall 76 and a rear wall 78. Bushing portion 72 includes a top plate 80. From a top perspective, bushing portion 72 is substantially rectangular with a length parallel to bracket portion 52. Front wall 76 and rear wall 78 define a width sized to be received in bushing slot 64 between yet closely adjacent to bracket front wall 56 and bracket rear wall 58. Bushing portion base 74 defines a rod bore 84 for receiving and encircling a cylindrical rod 40. Bore 84 is preferably sized to allow rod 40 to rotate and translate within bore 84. Bore 84 may optionally include bearing surfaces which enable and assist in free translation and rotation of rod 40, for example bore 84 may include or be coated in low-friction and/or lubricated materials such as DELRON® plastic or a TEFLON® coating or it may incorporate a ball-bearing arrangement.

A pair of flexible tabs 90 extend from opposing sidewalls of base 74. As illustrated, the tabs 90 have lower ends connected to base 74. Tabs 90 extend upward to free ends 94 which are accessible through openings defined in top plate 80. A midpoint of each tab 90 defines an engagement shelf 92. Each engagement shelf 92 has a flat upward face parallel to top plate 80 and an inward angled lower face. The upper end 94 of each tab can be manipulated, for example manually with a user's fingers, to flex tab 92 and shelf 92 inward. The upper ends 94 may be flush with the surface of top plate 80 or alternately may be slightly inset downward or may slightly protrude upward.

To couple the bushing assembly 50, bushing portion 72 can be introduced into bushing slot 64 and advanced downward. Preferably the spacing between the upper portions of bracket sidewalls 66 is slightly less than the distance defined by the extension of engagement shelves 92. As bushing portion 72 advances into bracket 52, the upper portions of sidewalls 66 are spaced to press against the tapered lower faces of shelves 92, causing both tabs 90 to flex inward and creating an outward biasing force. When advanced a sufficient distance, the shelves 92 match the height of engagement gaps 68, allowing the shelves 92 to rebound outward and enter engagement gaps 68. The upper facing surface of each shelf 92 is then below and abuts a downward facing surface of a corresponding sidewall 66 in engagement gaps 68, locking bushing portion 72 into bracket portion 52. When decoupling is desired, the user can manually flex tab upper ends 94 inward, disengaging the shelves 92 from engagement gaps 68. For instance, a pinching motion can be used to flex both tabs 90 simultaneously. Bushing portion 72 can then be raised upward and removed from bracket portion 52. When present, a soccer rod 40 can be used as a handle or lever to facilitate raising and lowering of bushing portion 72.

In certain embodiments, table soccer can be placed with a substantially spherical soccer ball game playing piece sized for a soccer game table. In some embodiments, table hockey or air hockey can be played with a symmetric disc-shaped hockey puck game playing piece sized for a hockey game table.

A game configuration includes using the game table configured with the soccer rods and playing figures in place and also using a hockey-puck style game playing piece. The soccer figures can be used to strike and propel the hockey puck across the game playing surface, preferably towards an opposing team's goal. Optionally, an air hockey style game playing piece is used which floats on an air cushion powered by an air pump.

FIGS. 5-8 illustrate views of an asymmetric game playing piece 100 usable in certain embodiments of the disclosure. Game playing piece 100 includes a disc shaped lower portion 102. In alternate embodiments, the lower portion may be formed in other geometric shapes such as ovals, triangles or squares for variations in game play. Lower portion 102 has a lower face 104 and an upper face 112. Lower face 104 is substantially flat. Optionally, lower portion 102 includes a lip portion 106 extending around the perimeter of lower portion 102. Lip portion 106 may have a height which slightly protrudes downward from the body of lower portion 102, slightly spacing the center portion upward and away from a support surface.

Extending upward from upper surface 112 is an upward projection portion 114. In the illustrated embodiment, upward projection portion 114 is formed with a vertical wall topped with a hemispherical dome section. Other profiles can be used as desired. The upward projection portion 114 provides sufficient height to game playing piece 100 to enable and allow the foot portions of soccer players on rods 40 to more easily strike and propel the game playing piece. For example, the height can be greater than 3/16". The upward projection portion 114 may be hollow to reduce weight. The weight and center of gravity of upward projection portion 114 make the game playing piece asymmetric and may decrease the chance of the game playing piece flipping over during game play.

The open center of lower portion 102 and the hollow volume of upward projection 114 define a cavity 108. When playing piece 100 rests on a support surface the contact area is limited to lip portion 106. When floating on an air cushion, lip portion 106 and cavity 108 assist in providing lift and aerodynamic performance.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A game table, comprising: a game playing bed on a support structure, said game playing bed including a substantially rectangular game playing surface facing upward; said game playing surface defining a pattern of perforations configured to expel forced air from an internal air pump to form an air cushion; a pair of opposing end walls arranged along opposing ends of said game playing surface, each end wall defining a goal opening; a pair of opposing sidewalls arranged along opposing sides of said game playing surface; a series of parallel soccer player rods extending through openings defined in said sidewalls; and, at least one simulated soccer figure mounted on each rod, wherein said soccer figures are arranged over said perforated game playing surface to strike a game playing piece supported on the air cushion above said game playing surface; wherein said rods are selectively removable without tools to convert the game table from a soccer playing configuration to a hockey playing configuration, wherein at least one end of each rod is arranged through a detachable bushing assembly mounted to a sidewall; and wherein each detachable bushing assembly includes a bracket portion mounted to a sidewall and a bushing portion encircling a rod, wherein said bushing portion can be selectively engaged and disengaged from said bracket portion.

2. The game table of claim 1, wherein said bushing portion is sized to be introduced into a bushing slot defined by said bracket portion and advanced downward to engage said bushing portion to said bracket portion.

3. The game table of claim 2, wherein said bushing portion defines a pair of flexible tabs each with an upward facing shelf portion and wherein said bracket includes sidewalls defining a pair of engagement gaps, wherein said shelves are biased to move into said engagement gaps to retain said bushing portion in said bracket portion.

4. The game table of claim 3, wherein said flexible tabs include upper ends which can be manually flexed inward to disengage said shelves from the engagement gaps to enable said bushing portion to be removed from said bracket portion.

5. The game table of claim 1, comprising an asymmetric game playing piece configured to be supported on said air cushion and propelled by said soccer figures, wherein said game playing piece includes a lower disc shaped portion and an upward projection portion; wherein an open center defined by said lower disc shaped portion and a hollow volume defined by said upward projection portion define a downward opening cavity.

6. The game table of claim 5, wherein said upward projection portion has a hemispherical dome section.

7. A game table, comprising:

a game playing bed on a support structure, said game playing bed including a substantially rectangular game playing surface;

a pair of opposing end walls arranged along opposing ends of said game playing surface, each end wall defining a goal opening;

a pair of opposing sidewalls arranged along opposing sides of said game playing surface;

a series of parallel soccer player rods extending through openings defined in said sidewalls;

at least one simulated soccer figure mounted on each rod, wherein said soccer figures are arranged over said perforated game playing surface; and, wherein at least one end of each rod is arranged through a detachable bushing assembly mounted to a sidewall wherein each detachable bushing assembly includes a bracket portion mounted to a sidewall and a bushing portion encircling a rod, wherein said bushing portion can be selectively engaged and disengaged from said bracket portion.

8. The game table of claim 7, wherein said bushing portion is sized to be introduced into a bushing slot defined by said bracket portion and advanced downward to engage said bushing portion to said bracket portion.

9. The game table of claim 8, wherein said bushing portion defines a pair of flexible tabs each with an upward facing shelf portion and wherein said bracket includes sidewalls defining a pair of engagement gaps, wherein said shelves are biased to move into the engagement gaps to retain said bushing portion in said bracket portion.

10. The game table of claim 9, wherein said flexible tabs include upper ends which can be manually flexed inward to disengage said shelves from the engagement gaps to enable said bushing portion to be removed from said bracket portion.

11. The game table of claim 7, comprising a game playing piece configured to be propelled by said soccer figures, wherein said game playing piece includes a lower disc shaped portion and an upward projection portion with a hemi-spherical dome section; wherein an open center defined by said lower disc shaped portion and a hollow volume defined by said upward projection portion define a downward opening cavity.

12. A game table, comprising:

a game playing bed on a support structure, said game playing bed including a substantially rectangular game playing surface;

said game playing surface defining a pattern of perforations which expel forced air from an internal air pump to form an air cushion;

a pair of opposing end walls arranged along opposing ends of said game playing surface, each end wall defining a goal opening;

a pair of opposing sidewalls arranged along opposing sides of said game playing surface;

a series of parallel soccer player rods extending through openings defined in said sidewalls at least one simulated soccer figure mounted on each rod, wherein said soccer figures are arranged over said perforated game playing surface;

a series of bushing assemblies wherein each rod is arranged through one permanent bushing assembly and one detachable bushing assembly;

wherein each detachable bushing assembly includes a bracket portion mounted to a sidewall and a bushing portion encircling a rod, wherein said bushing portion can be selectively engaged and disengaged from said bracket portion; and, an asymmetric game playing piece supported on said air cushion with a height sized to be propelled by said soccer figures, wherein said game playing piece includes a lower disc shaped portion and an upward projection portion.

13. The game table of claim 12, wherein the game playing piece has a height greater than 3/16".

14. The game table of claim 13, wherein said bushing portion defines a pair of flexible tabs each with an upward facing shelf portion and wherein said bracket includes sidewalls defining a pair of engagement gaps, wherein as said bushing portion is advanced into said bracket portion said sidewalls apply a biasing force to said tabs and wherein when aligned said shelves are biased to rebound into the engagement gaps to retain said bushing portion in said bracket portion.

15. The game table of claim 14, wherein said flexible tabs include upper ends which can be manually flexed inward to disengage said shelves from the engagement gaps to enable said bushing portion to be removed from said bracket portion.

16. The game table of claim 13, wherein said upward projection portion has a hemi-spherical dome section.

* * * * *